US009936300B2

(12) United States Patent
Hunstable

(10) Patent No.: US 9,936,300 B2
(45) **Date of Patent: *Apr. 3, 2018**

(54) TRANSDUCER AND METHOD OF OPERATION

(71) Applicant: Linear Labs, Inc., Granbury, TX (US)

(72) Inventor: Fred E. Hunstable, Granbury, TX (US)

(73) Assignee: Linear Labs, Inc, Granbury, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/976,367

(22) Filed: Dec. 21, 2015

(65) Prior Publication Data

US 2016/0112805 A1 Apr. 21, 2016

Related U.S. Application Data

(63) Continuation of application No. 14/636,143, filed on Mar. 2, 2015, now Pat. No. 9,219,962, which is a continuation of application No. PCT/US2013/057888, filed on Sep. 3, 2013.

(60) Provisional application No. 61/696,280, filed on Sep. 3, 2012.

(51) Int. Cl.

| | |
|---|---|
| ***H04R 9/02*** | (2006.01) |
| ***H04R 9/06*** | (2006.01) |
| *H04R 9/04* | (2006.01) |

(52) U.S. Cl.

CPC ..... *H04R 9/025* (2013.01); *H04R 9/063* (2013.01); *H04R 9/041* (2013.01); *H04R 2209/022* (2013.01)

(58) Field of Classification Search

CPC ..... H04R 9/00; H04R 9/025; H04R 9/027; H04R 29/003; H04R 2209/00; H04R 2209/41

USPC ..... 381/396, 400–403, 412, 414, 416–418, 381/420–422

See application file for complete search history.

(56) References Cited

U.S. PATENT DOCUMENTS

| | | | |
|---|---|---|---|
| 1,349,100 | A | 8/1920 | Reynolds et al. |
| 3,135,880 | A | 6/1964 | Olson et al. |
| 3,656,015 | A | 4/1972 | Gillium |
| 3,666,977 | A | 5/1972 | Helms et al. |
| 3,740,594 | A | 6/1973 | Casey |
| 3,751,693 | A | 8/1973 | Gabor |
| 3,939,367 | A | 2/1976 | Ramirez |
| 3,949,249 | A | 4/1976 | Wiseley et al. |
| 3,984,706 | A | 10/1976 | Inouye |
| 4,217,507 | A | 8/1980 | Jaffe et al. |
| 4,243,899 | A | 1/1981 | Jaffe |

(Continued)

FOREIGN PATENT DOCUMENTS

| | | | |
|---|---|---|---|
| CN | 201206539 | Y | 3/2009 |
| DE | 19839464 | A1 | 3/2000 |

(Continued)

OTHER PUBLICATIONS

Australian Office Action received in Australian Patent Application No. 2011316872 dated Jul. 27, 2015, 4 pages.

(Continued)

*Primary Examiner* — Suhan Ni
(74) *Attorney, Agent, or Firm* — Bill R. Naifeh

(57) ABSTRACT

In one embodiment, there is described a new transducer, and in particular an improved system and method for producing linear motion for a transducer such as used in voice coils converting from an electrical input to a mechanical linear motion input.

20 Claims, 6 Drawing Sheets

(56) References Cited

U.S. PATENT DOCUMENTS

| | | | |
|---|---|---|---|
| 4,317,058 | A | 2/1982 | Blalock |
| 4,318,038 | A | 3/1982 | Munehiro |
| 4,415,821 | A | 11/1983 | Wedman et al. |
| 4,445,798 | A | 5/1984 | Munehiro |
| 4,518,882 | A | 5/1985 | Morino et al. |
| 4,785,210 | A | 11/1988 | Maruyama et al. |
| 4,845,392 | A | 7/1989 | Mumbower |
| 4,858,452 | A | 8/1989 | Ibrahim |
| 5,099,158 | A | 3/1992 | Stuart et al. |
| 5,177,383 | A | 1/1993 | Sim |
| 5,220,223 | A | 6/1993 | Mehnert |
| 5,231,336 | A | 7/1993 | Namen |
| 5,434,458 | A | 7/1995 | Stuart et al. |
| 5,440,183 | A | 8/1995 | Denne |
| 5,539,262 | A | 7/1996 | Strugach |
| 5,631,505 | A | 5/1997 | Stephany et al. |
| 5,757,093 | A | 5/1998 | Susliaev et al. |
| 5,777,403 | A | 7/1998 | Yuan |
| 5,808,379 | A | 9/1998 | Zhao |
| 5,818,131 | A | 10/1998 | Zhang |
| 6,049,146 | A | 4/2000 | Takara |
| 6,066,998 | A | 5/2000 | Trumper et al. |
| 6,075,297 | A | 6/2000 | Izawa et al. |
| 6,097,125 | A | 8/2000 | Park et al. |
| 6,163,091 | A | 12/2000 | Wasson et al. |
| 6,242,823 | B1 | 6/2001 | Griswold |
| 6,278,204 | B1 | 8/2001 | Frenette |
| 6,365,993 | B1 | 4/2002 | Calhoon et al. |
| 6,952,060 | B2 | 10/2005 | Goldner et al. |
| 7,078,833 | B2 | 7/2006 | Xu |
| 7,276,820 | B2 | 10/2007 | Tang et al. |
| 7,288,862 | B2 | 10/2007 | Song et al. |
| 7,439,640 | B2 | 10/2008 | Takeuchi |
| 7,476,991 | B2 | 1/2009 | Chang |
| 7,501,724 | B2 | 3/2009 | Tang et al. |
| 7,528,561 | B2 | 5/2009 | Kawai et al. |
| 7,579,722 | B1 | 8/2009 | Borchert |
| 8,110,950 | B2 | 2/2012 | Moriyama et al. |
| 8,922,070 | B2 | 12/2014 | Hunstable |
| 9,219,962 | B2 | 12/2015 | Hunstable |
| 9,325,219 | B2 | 4/2016 | Hunstable |
| 9,325,232 | B1 | 4/2016 | Hunstable |
| 2001/0007400 | A1 | 7/2001 | Griswold |
| 2003/0102732 | A1 | 6/2003 | Matsuda |
| 2004/0155536 | A1 | 8/2004 | Cordiale et al. |
| 2004/0239199 | A1 | 12/2004 | Qu et al. |
| 2004/0245861 | A1 | 12/2004 | Miyajima et al. |
| 2005/0046282 | A1 | 3/2005 | Tang et al. |
| 2006/0055251 | A1 | 3/2006 | Hsian |
| 2006/0261680 | A1 | 11/2006 | Moon et al. |
| 2008/0308199 | A1 | 12/2008 | Locker |
| 2010/0001592 | A1 | 1/2010 | Kawano et al. |
| 2012/0098357 | A1 | 4/2012 | Hunstable |
| 2013/0026279 | A1 | 1/2013 | Agrikli |
| 2017/0025923 | A1 | 1/2017 | Hunstable |

FOREIGN PATENT DOCUMENTS

| | | | |
|---|---|---|---|
| DE | 202007001534 | U1 | 4/2007 |
| EP | 0566959 | A1 | 10/1993 |
| GB | 2286928 | A | 8/1995 |
| JP | 58204761 | A | 6/1986 |
| JP | H0918992 | A | 1/1997 |
| JP | 2000152558 | A | 5/2000 |
| KR | 100770590 | | 10/2007 |
| RU | 140346 | U1 | 5/2014 |
| WO | 0046910 | A1 | 8/2000 |
| WO | 2017008085 | A1 | 1/2017 |

OTHER PUBLICATIONS

Chinese Second Office Action received in Chinese Patent Application No. 201180058326.4 dated Oct. 28, 2015, 10 pages.
European Office Action received in European Patent Application No. 11776307.8 dated Feb. 2, 2015, 5 pages.
International Search Report and Written Opinion received in Patent Cooperation Treaty Application No. PCT/US2011/057318, dated Jan. 25, 2012, 11 pages.
International Search Report and Written Opinion received in Patent Cooperation Treaty Application No. PCT/US2013/057888, dated Jan. 17, 2014, 15 pages.
Mexican Office Action received in Mexican Patent Application No. 18182 dated Apr. 23, 2014, 5 pages.
Office Action and translation received in Chinese Application No. 201180058326.4, dated Mar. 4, 2015,18 pages.
Office Action received in European Application No. 11776307.8 dated Jun. 16, 2014, 4 pages.
Office Action received in European Application No. 11776307.8 dated Sep. 18, 2015, 4 pages.
Australian Exam Report No. 2, dated Apr. 11, 2016, re AU Patent App No. 2011316872.
Australian Notice of Acceptance, dated Jul. 26, 2016, re Patent App No. 2011316872.
Chinese Third Office Action, dated Mar. 15, 2016, re Patent App No. 801180058326.4.
Chinese Notification to Grant Patent Right, dated Jul. 27, 2016, re Patent App No. 201180058326.4.
International Search Report and Written Opinion, dated Nov. 3, 2016, by the ISA/RU, re PCT/US2016/041818.
Notice of Allowance, dated Aug. 14, 2015, by the USPTO, re U.S. Appl. No. 14/636,143.
Notice of Allowance with Examiner's Amendment, dated Sep. 14, 2015, by the USPTO, re U.S. Appl. No. 14/636,143.
Notice of Allowance, dated Aug. 27, 2014, by the USPTO, re U.S. Appl. No. 13/279,079.
Notice of Allowance, dated Oct. 6, 2015, by the USPTO, re U.S. Appl. No. 13/185,109.
Notice of Allowance, dated Dec. 18, 2015, by the USPTO, re U.S. Appl. No. 13/185,109.
Notice of Allowance, dated Jan. 8, 2016, by the USPTO, re U.S. Appl. No. 13/185,109.
Notice of Allowance, dated Jan. 25, 2016, by the USPTO, re U.S. Appl. No. 14/554,023.
Office Action, dated Dec. 24, 2014, by the USPTO, re U.S. Appl. No. 13/185,109.
Office Action, dated Jan. 31, 2014, by the USPTO, re U.S. Appl. No. 13/279,079.
Office Action, dated Sep. 2, 2015, by the USPTO, re U.S. Appl. No. 14/554,023.
Restriction Requirement, dated May 23, 2014, by the USPTO, re U.S. Appl. No. 13/185,109.
Office Action, dated Apr. 10, 2017, by the USPTO, re U.S. Appl. No. 15/089,545.

TRANSDUCER AND METHOD OF OPERATION

CROSS REFERENCE TO RELATED APPLICATIONS

This application is a continuation of U.S. application Ser. No. 14/636,143 filed Mar. 2, 2015 entitled "Transducer and Method of Operation," which claims the benefit of the filing date of a PCT patent application having an International Patent Application Number of PCT/US2013/057888, entitled "AN IMPROVED TRANSDUCER AND METHOD OF OPERATION" filed on Sep. 3, 2013 which claims the benefit of a patent U.S. provisional patent application Ser. No. 61/696,280, filed on Sep. 3, 2012, entitled "An Improved Voice Coil for a Speaker and Method of Operation," the disclosures of which are incorporated herein by reference for all purposes.

TECHNICAL FIELD

The invention relates in general to transducers such as used in loud speakers using cones for producing air movement and in particular to an improved transducer or voice coil for a speaker and method of operation.

BACKGROUND INFORMATION

The concept behind most transducers, such as linear motors used today as solenoids and voice coils used in loudspeakers have not substantially changed since they were first developed. Though substantial progress has been made in materials, magnet technology, and refinements, from an operational perspective, voice and solenoid coils have essentially remained unchanged.

Transducers and voice coils typically work on the Lorentz Force Principle, which essentially states that if a conductor carrying current is placed in a magnetic field, a force will act upon the conductor. The magnitude of this force depends on various factors such as the number of conductors, the current, the length of the conductor and the magnetic flux density.

For example, a voice coil (consisting of a former, collar, and winding) is typically a coil of wire attached to the apex of a loudspeaker cone. It provides the motive force to the cone by the reaction of a magnetic field to the current passing through it. By driving a current through the voice coil, a magnetic field is produced. This magnetic field causes the voice coil to react to the magnetic field from a permanent magnet fixed to the speaker's frame, thereby moving the cone of the speaker. By applying an audio waveform to the voice coil, the cone will reproduce the sound pressure waves, corresponding to the original input signal.

From a basic perspective, a transducer or voice coil used in speakers have the same inherent problems and energy losses as traditional linear motors (or their equivalents). For instance, because the moving parts of the speaker must be of low mass (to accurately reproduce high-frequency sounds), voice coils are usually made as light weight as possible, making them delicate. Passing too much power through the coil can cause it to overheat. Voice coils wound with flattened wire, called ribbon-wire, provide a higher packing density in the magnetic gap than coils with round wire. Some coils are made with surface-sealed bobbin and collar materials so they may be immersed in a ferrofluid which assists in cooling the coil, by conducting heat away from the coil and into the magnet structure. Excessive input power at low frequencies can cause the coil to move beyond its normal limits, causing knocking and distortion.

To varying degrees, power losses present in linear motors are also present in transducers and voice coils. These losses resistive heating of the conductors, bearing losses and windage losses. These additional losses are typically referred to as hysteresis losses, inductive kickback, counter-emf., cogging, and magnetic buffeting of permanent magnet materials. A reduction or elimination of these losses would produce a more efficient transducer.

Additionally, most existing transducers and voice coils use tight clearances. Tight clearances are needed in traditional voice coils order to make use of a Lorentz force to generate movement of the conductors. The length of the field approximates the maximum distance the voice coil conductors can move. Increasing the stroke length or increasing the output power would be advantageous if one could accomplish that without increasing input power, cost, and/or heat. However, if the stroke length of the face of the pole piece is increased, the flux density available at each conductor would not change and might actually decrease. Thus, more power would be needed to achieve the same degree of movement or output power.

Lentz's law states that a counter force or counter-emf will exist to resist this movement which is felt particularly as we increase the power input to the coil and amperage increases.

Thus, some of the major inefficiencies in transducers or voice coils may be due to:

Flux density
Stroke length Clearances
$I^2R$ losses or Power losses
Counter-EMF
Heat Transfer What is needed, therefore, is a transducer, such as used in voice coils of loud speakers that minimizes such inefficiencies resulting in a more energy efficient device.

SUMMARY

In response to these and other problems, in one embodiment, there is a new transducer, and in particular an improved system and method for producing linear motion for a transducer such as used in voice coils converting from an electrical input to a mechanical linear motion input.

For instance, in some embodiments, a transducer, comprises a circular magnetic channel having a longitudinal axis, including: an exterior magnetic cylinder positioned concentrically to the longitudinal axis and having a first plurality of magnetic poles at an interior face which are generally transverse to and pointing at the longitudinal axis; an interior magnetic cylinder positioned concentrically to the longitudinal axis and having a second plurality of magnetic poles at an exterior face which are generally transverse to and pointing away from the longitudinal axis; a base magnetic ring positioned at one longitudinal end of the exterior and interior magnetic cylinders to form the circular magnetic channel and having a third polarity of magnetic poles at an inward facing face which are generally parallel to the longitudinal axis, wherein the first plurality, second plurality, and third plurality of magnetic poles are the same polarity, and a moveable coil assembly at least partially positionable within the circular magnetic channel wherein the coil assembly may move in a direction generally parallel to the longitudinal axis when current is applied to the moveable coil assembly.

These and other features, and advantages, will be more clearly understood from the following detailed description taken in conjunction with the accompanying drawings. It is important to note the drawings are not intended to represent the only aspect of the invention.

DETAILED DESCRIPTION

Figure 1:
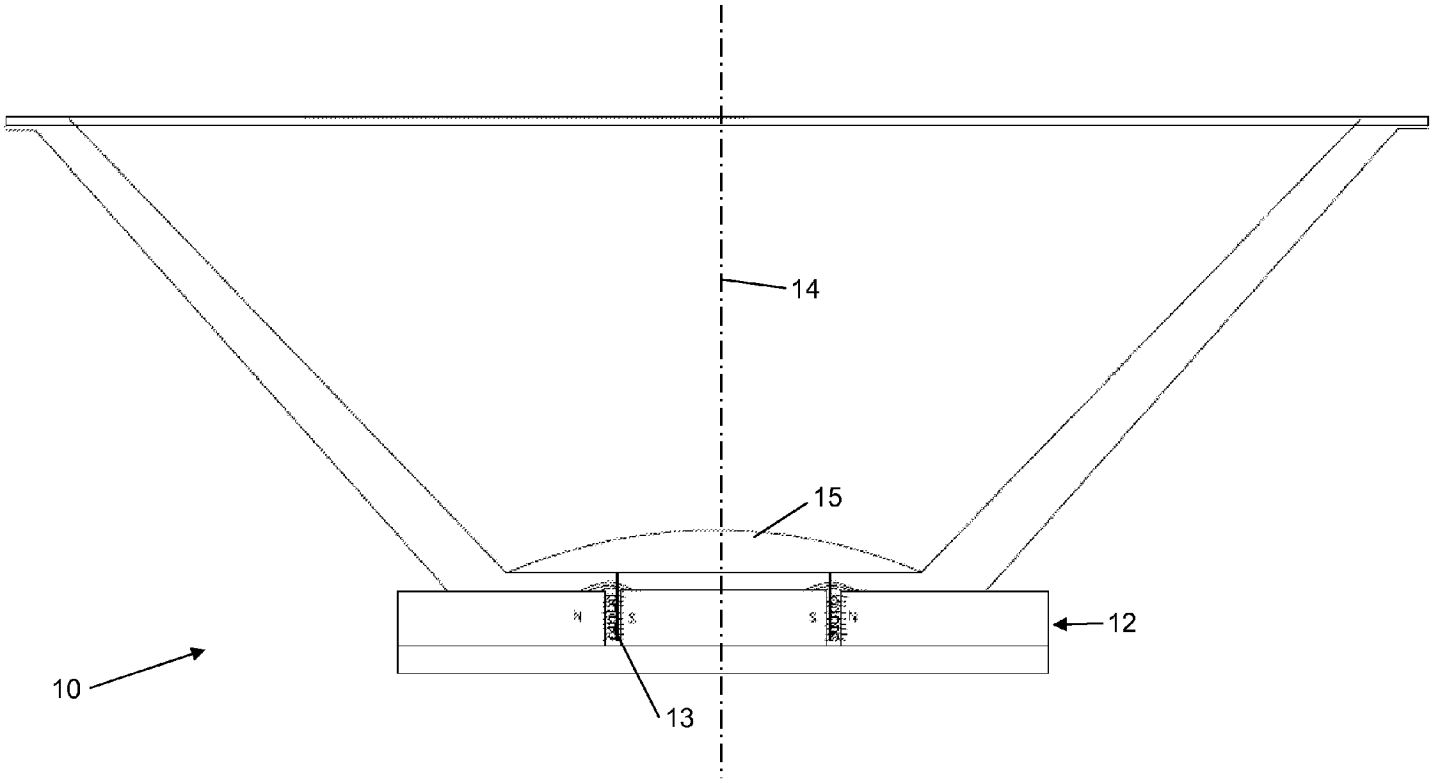
FIG. 1. is a conceptual section view illustrating one embodiment of a prior art speaker.

For the purposes of promoting an understanding of the principles of the present inventions, reference will now be made to the embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the inventions as described herein are contemplated as would normally occur to one skilled in the art to which the invention relates.

Specific examples of components, signals, messages, protocols, and arrangements are described below to simplify the present disclosure. These are, of course, merely examples and are not intended to limit the invention from that described in the claims. Well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art. Details regarding control circuitry or mechanisms used to control the movement of the various elements described herein are omitted, as such control circuits are within the skills of persons of ordinary skill in the relevant art.

When directions, such as upper, lower, top, bottom, clockwise, counter-clockwise, inward, and outward are discussed in this disclosure, such directions are meant to only supply reference directions for the illustrated figures and for orientated of components in the figures. The directions should not be read to imply actual directions used in any resulting invention or actual use. Under no circumstances, should such directions be read to limit or impart any meaning into the claims.

Turning now to FIG. 1, there is presented a section view of a loudspeaker 10. A conventional transducer or short stroke linear motor may be used as a voice coil 12 in the loudspeaker 10. When a current impressed by a particular voltage is injected into coil conductors 13, a Lorentz force is generated causing movement of the conductors. Current of a particular polarity will cause the conductors to move in a direction parallel to its longitudinal axis 14. The coil conductors are coupled to a voice cone 15 such that when they move in a particular direction, the voice cone follows. The movement of the voice cone 15 creates an air pressure wave which human ears perceive as a sound. After each electrical input the cone 15 is mechanically pulled back to center by the spring action of the cone material.

Modulation of the magnitude and amplitude of the current creates a continuous sound wave to be generated which can be an accurate representation of the input signal. This signal is supplied by electronic controllers such as audio amplifiers to reproduce an original waveform into sound waves we hear as speech, music, etc.

The strength of magnetic flux acting on the coil conductors 13 directly affects the strength of the movement for a given amperage. Thus, to lower the power input requirements for a gain in efficiency requires ever stronger magnetic flux fields. Most conventional speakers use larger or more powerful magnetic materials to produce stronger magnetic flux fields.

Figure 2:
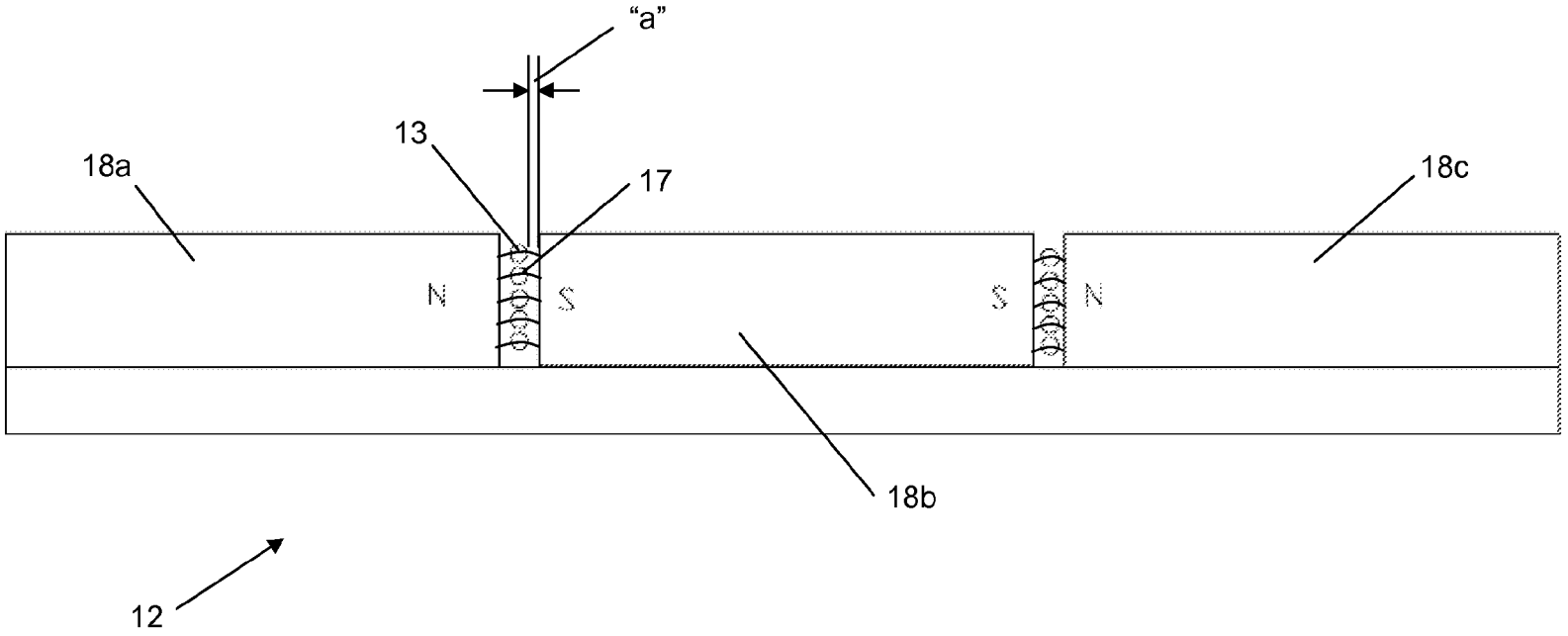
FIG. 2 is a conceptual section view illustrating one embodiment of a prior art voice coil.

FIG. 2 is a detailed section view of the traditional voice cone 12. Another difficulty with increasing the stroke length is the precision and tight clearances that need to be maintained in order that the coil conductors can properly react with the magnetic flux forces. In traditional voice coils, such as the voice coil 12 tight clearances "a" between the coil conductors 13 and the stationary magnets 18*a*, 18*b*, and 18*c* are usually desired in order to take advantage of the extremely high flux densities 17 that exist near the pole faces. Note that the pole of the stationary magnet 18*a* is opposite to that of pole of the stationary magnet 18*b* with respect to coil conductor space "a." These tight clearances also restrict how easily heat can be dissipated as it may be impractical to utilize larger conductor sizes and lengths in such tight confines.

For a given size of voice coil increasing the stroke length to move a given volume of air via a voice cone 15 can produce significant benefits if this can be accomplished without increasing the power consumed. However, increasing the stroke length requires precision in the tight clearances that need to be maintained in order that the coil conductors can properly react with the magnetic flux forces 13. In traditional voice coils, tight clearances "a" between the coil conductor 13 and the stationary magnets 18*a*, 18*b*, and 18*c* are usually desired in order to take advantage of the extremely high flux densities that exist near the pole faces. These tight clearances also restrict how easily heat can be dissipated as it may be impractical to utilize larger conductor sizes and lengths in such tight confines.

Figure 3:
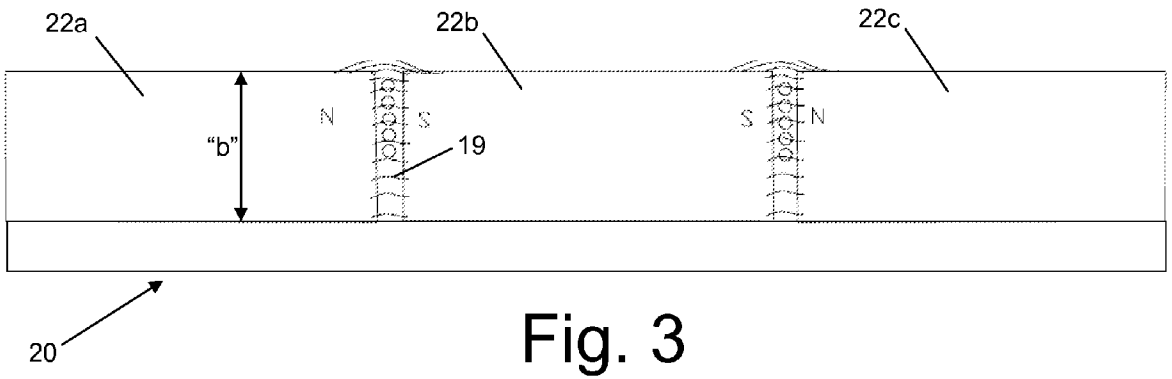
FIG. 3 is a conceptual section view illustrating an alternative embodiment of a prior art voice coil.

FIG. 3 is a conceptual section illustration of a voice coil or transducer 20 with larger magnets 22*a*, 22*b*, and 22*c* to illustrate a larger stroke length "b." As illustrated in FIG. 2, simply increasing the size of the magnets does not increase the flux strength density 19, in fact it can actually reduce it at the expense of increasing stroke length.

Figure 4:
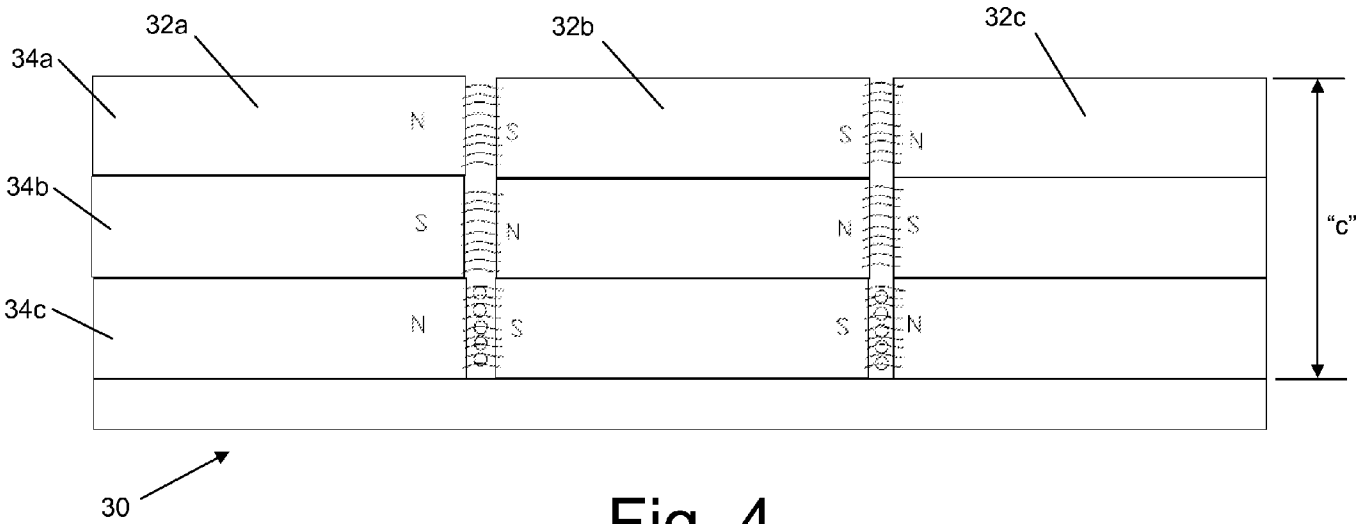
FIG. 4 is a conceptual section view illustrating one embodiment of a prior art voice coil.

FIG. 4 illustrates a voice coil 30 with magnetic stacks 32*a*, 32*b*, and 32*c* comprising "stacks" of individual magnets, such as magnets 34*a*, 34*b*, and 34*c*. The use of "magnet stacks," such as is used in some linear motor technology can increase the stroke length "c" as shown in FIG. 4. Unfortunately, this approach requires a complex electronic controller which may have difficulties reproducing sound waves above several hundred hertz.

Figure 5:
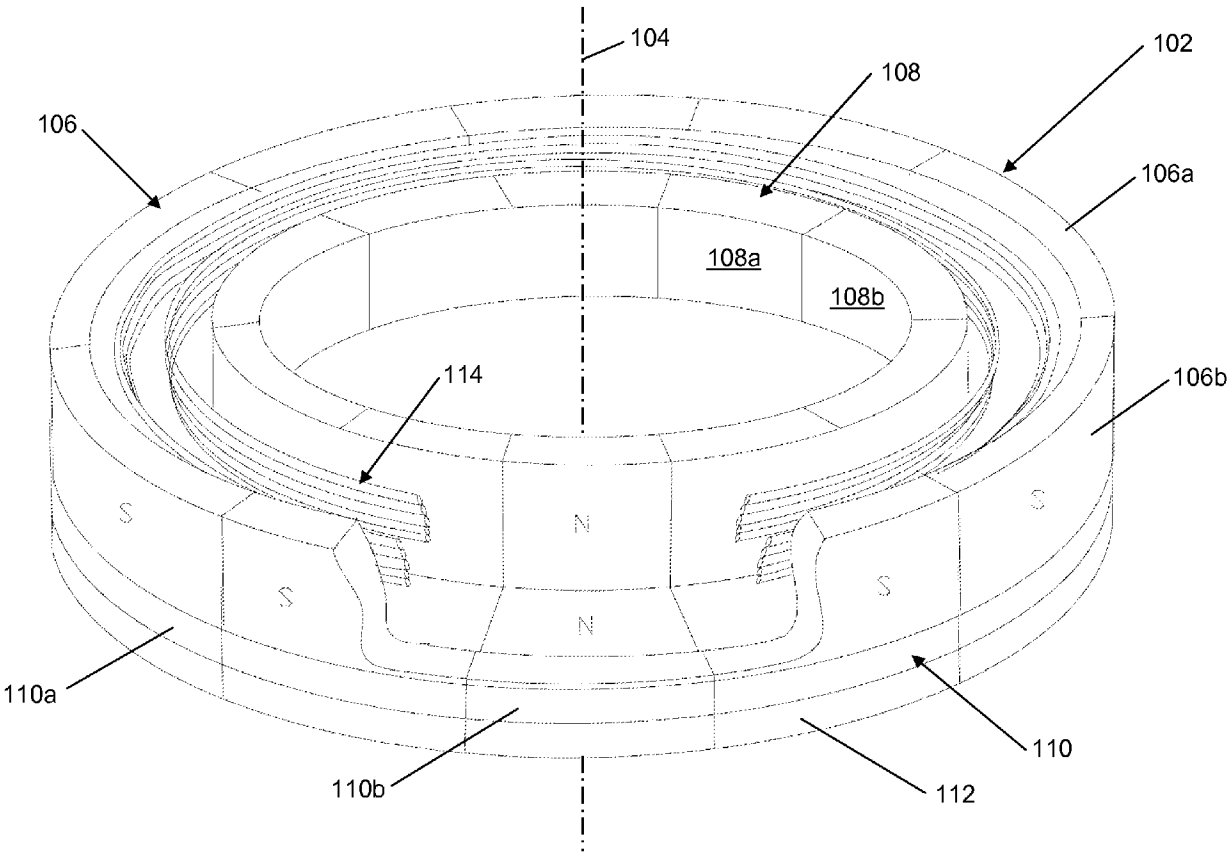
FIG. 5 is a conceptual isometric view illustrating one embodiment of the present invention.

FIG. 5 is a conceptual isometric drawing of some of components of an improved transducer or base assembly 100, which in some applications may be used for a voice coil. In certain embodiments, there may be a circular magnetic channel 102 having a longitudinal axis 104.

In certain embodiments, the circular magnetic channel 102 may comprise an outer magnetic confinement cylinder or exterior magnetic cylinder 106 positioned concentrically about the longitudinal axis 104. The circular magnetic channel 102 also comprises an inner magnetic confinement cylinder or interior magnetic cylinder 108 which is also positioned concentrically with respect to the exterior magnetic cylinder 106 and the longitudinal axis 104.

In certain embodiments, the circular magnetic channel 102 also comprises a base confinement ring or base magnetic ring or cap 110 positioned at one longitudinal end of the magnetic cylinders 106 and 108. The base magnetic ring 110 is also positioned concentrically about the longitudinal axis 104. Thus, in section, magnetic cylinders 106, 108, and the base magnetic ring 110 form a dual magnetic channel or U-shaped elements as illustrated in FIG. 6.

In some embodiments, a base backer plate 112 may also be positioned adjacent to the base magnetic ring 110. The backer plate 112 may be steel or any conductive or non-conductive material.

As will be explained below, a moveable coil assembly 114 may be positioned or partially positioned within an interior space 116 of the circular magnetic channel 102 and may move in a direction which is generally parallel to the longitudinal axis 104 when current is applied to or energizes the moveable coil assembly.

Figure 6:
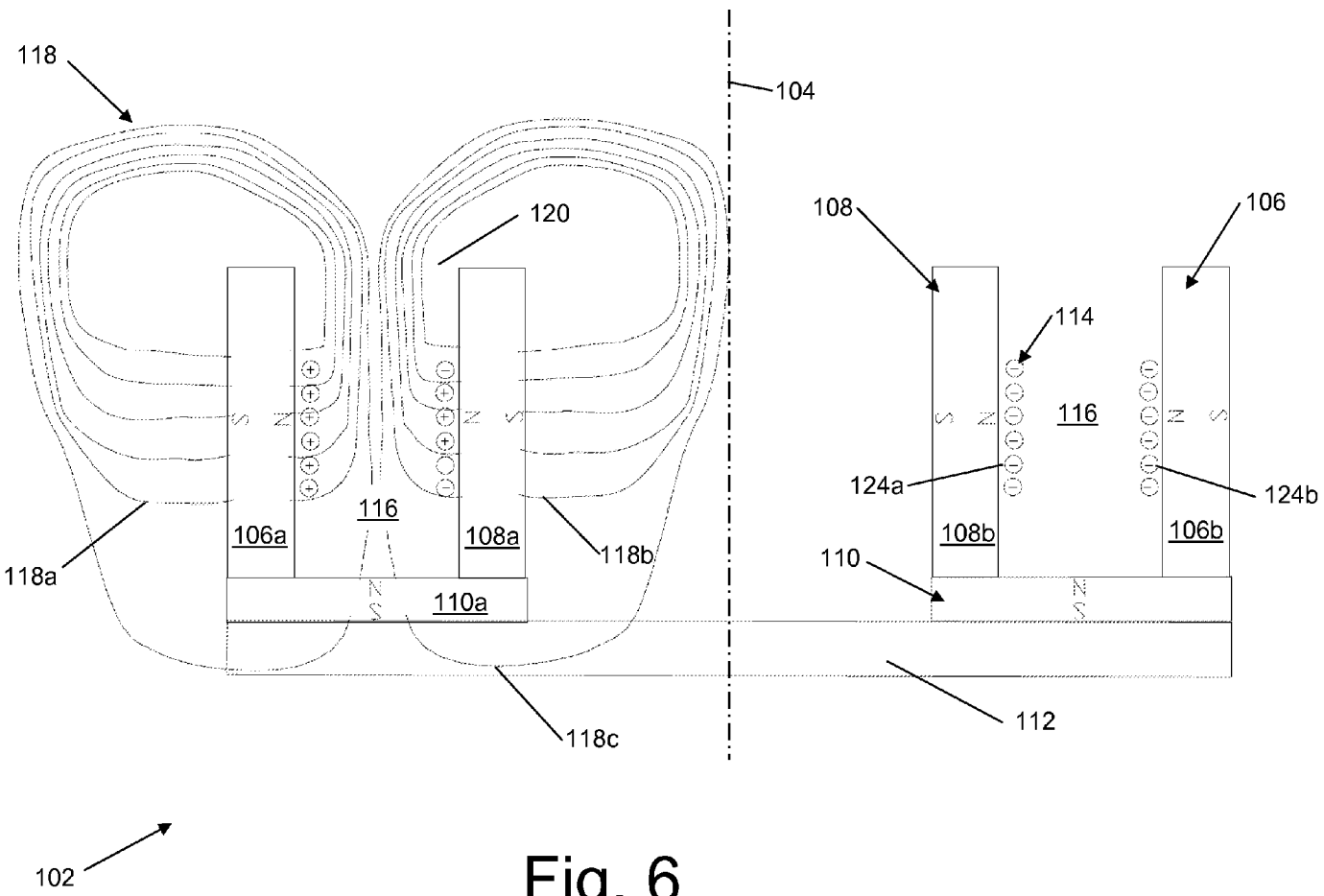
FIG. 6 is a section view of the embodiment illustrated in FIG. 5.

FIG. 6 is a section view of the circular magnetic channel 102 illustrating the exterior magnetic cylinder 106, the interior magnetic cylinder 108, the base magnetic ring 110, the base backer plate 112, and the coil conductor assembly 114 in section. Note that for purposes of illustration only, when a positive sign is used on a coil conductor, the positive sign indicates that the coil conductor current is going into the plane of the illustration. Conversely, when a negative sign is used on a coil conductor, the negative sign indicates that the coil conductor current is coming out of the plane of the illustration.

As indicated in FIG. 5, in some embodiments, the exterior magnetic cylinder 106 may be formed by using multiple magnetic segments 106*a*, 106*b* etc. to form the exterior magnetic cylinder. Each magnetic segment 106*a*, 106*b*, etc. within the exterior magnetic cylinder 106 has a magnetic pole which is aligned to face the longitudinal axis. Furthermore, the poles of the magnetic segments 106*a*, 106*b*, etc. are aligned so that the poles of the same polarity face inward towards the longitudinal axis or outward away from the longitudinal axis. For instance, in the illustration of FIG. 5, all north magnetic poles of the segments 106*a*,106*b* etc. on the interior or channel side of the magnetic circular cylinder 106 face the longitudinal axis 104 and all south magnetic poles face away from the longitudinal axis.

The interior magnetic cylinder 108 may also be formed by using multiple magnetic segments 108*a*, 108*b*, etc. to form the interior magnetic cylinder. Each magnetic segment 108*a*, 108*b*, etc. within the interior magnetic cylinder 108 has a magnetic pole which is aligned to face the longitudinal axis 104. Furthermore, the poles of the magnetic segments are aligned so that the poles of the same polarity face inward towards the longitudinal axis or outward away from the longitudinal axis. For instance, in the illustration of FIG. 5, all north magnetic poles of the segments 108*a* and 108*b* comprising the interior magnetic cylinder 108 face away from the longitudinal axis 104 (towards the cylinder's 108 exterior face or the "channel face") and all south magnetic poles face towards the longitudinal axis 104.

Similarly, the base magnetic ring 110 may also be formed by using multiple magnetic segments 11Oa, 11Ob, etc. to form the base magnetic ring. Each magnetic segment 11Oa, 11Ob, etc. within the base magnetic ring 110 has a magnetic pole which is aligned in a direction which is generally parallel to the longitudinal axis 104. Furthermore, the polarity of the poles of the magnetic segments 11Oa and 11Ob, etc. are aligned so that the same polarity faces the same direction which is parallel to the longitudinal axis 104. For instance, in the illustration of FIG. 5, all north magnetic poles of the segments 11Oa and 11Ob comprising the base magnetic ring 110 face inward towards the interior space 116 of the channel 102 and all south magnetic poles face away from the interior of the channel towards the backer plate 112.

Thus, as can be illustrated by FIG. 6, all the inward channel facing poles of the exterior magnetic cylinder 106, the interior magnetic cylinder 108, and the base magnetic ring 110 face towards the interior 116 of the channel. For instance, the north poles of the exterior magnetic cylinder 106, the interior magnetic cylinder 108, and the base magnetic ring 110 all face towards the interior space 116 of the circular magnetic channel 102.

In certain embodiments, the magnetic cylinders 106 and 108, and the magnetic ring 110 or the individual magnetic segments 106*a*, 106*b*, 108*a*, 108*b*, 11Oa, and 11Ob, etc. may be made of out any suitable magnetic material, such as: neodymium, Alnico alloys, ceramic permanent magnets, or even electromagnets. The exact number of magnets or electromagnets will be dependent on the required magnetic field strength or mechanical configuration. The illustrated embodiment is only one way of arranging the magnets, based on certain commercially available magnets. Other arrangements are possible—especially if magnets are manufactured for this specific purpose.

In certain embodiments, the individual magnetic segments 106*a*, 106*b*, 108*a*, 108*b*, 11Oa, and 11Ob, etc. may be held in place by an appropriate securing method known in the art, such as casting the magnetic segments in resin, epoxying the magnetic segments to a substrate, or by securing the magnetic segments with mechanical fasteners and or confinement rings. In other embodiments, the magnetic segments may be formed into a stable geometric shape as illustrated in FIG. 5.

Furthermore, in some embodiments magnetic stacking may be employed. For instance, turning to FIG. 5, there is shown one "row" or "stack" of magnetic segments forming the circular magnetic channel 102, but depending on the required magnetic fluxfield strength of the magnetic circular cylinder 102 or the desired stroke length (described above), any number of magnetic rows or stacks may be used to assemble the magnetic circular cylinder 102.

The permanent magnets comprising the circular magnetic channel 102 generate magnetic flux forces which can be represented for purposes of this specification as magnetic flux lines. A simplified representation of the flux lines (or forces) 118 is illustrated on the left side of FIG. 6. Such forces, of course, are also present on both sides of the circular magnetic channel 102, but are not shown on the right side for reasons of clarity. The actual shape, direction, an orientation of the magnetic flux forces 118 depend on factors such as the use of an interior retaining ring, or the use of ferrous or non ferrous metallic end plate, or an end plate consisting of magnetic assemblies oriented to force the lines of flux out of one end of the magnetic cylinder.

In some conventional configurations, the opposing poles of the magnets are usually aligned longitudinally. Thus, the field flux forces will "hug" or closely follow the surface of the magnets. So, when using conventional electric motive equipment, the clearances must usually be extremely tight in order to be able to act on these lines of force. By aligning the magnetic poles of each radially towards the center 116 of the circular magnetic channel, the magnetic flux forces tend to stack up (or are "stacked") as they pass through the center 116 of the circular magnetic channel 102 and radiate perpendicularly from the surface of the magnets. This configuration allows for greater tolerances between the moveable coil assembly 114 and the interior or channel face of the magnets comprising the circular magnetic channel 102. In conventional systems, the tolerances or gaps between the coils and the interior surface of the magnets may be just enough so that the thermal expansion would not allow the coils to impinge on their respective magnet assemblies, but may not allow sufficient gaps for cooling. When larger gaps are used, cooling may be accomplished by air flowing into the gaps.

In this illustrative embodiment, the magnetic flux lines (or forces) 118 will tend to develop a stacking effect and the use of the base magnetic ring 110 manipulates the flux lines or forces 118 of the magnets in the circular magnetic channel 102 such that most or all of the flux lines or forces 118 flows out of an open end 120 of the circular magnetic channel. For instance, the magnetic flux forces or lines generated by the magnet 106*a* (e.g. flux force line 118*a*) tends to exit its interior face or "channelface" (or its north pole), circle around the open end 120 of the circular magnetic channel 102 and return to the south pole or exterior face of the magnet 106*a*. Similarly, the magnetic flux lines or forces generated by the magnet 108*b* (e.g. flux force line 118*b*) tends to exit its exterior face or "channel face" (or its north pole), circle around the open end 120 of the circular magnetic channel 102 and return to the south pole or its interior face (with respect to the longitudinal axis 104) of the magnet 108*b*. The magnetic flux forces tend to follow this pattern for each successive flux line or flux force within the circular magnetic cylinder 102.

The flux lines (e.g., flux line 118*c*) or forces of the magnet segments 11Oa of the magnetic end cap or base ring 110 will also flow towards the interior space 116 and out the open end 120 and back around the closed end the circular magnetic channel. Thus, the flux forces produced by the magnets of the circular magnetic channel have an unobstructed path to exit through the interior space 116 of the circular magnetic channel 102 and return to its opposing pole on the exterior of the channel.

Figure 7:
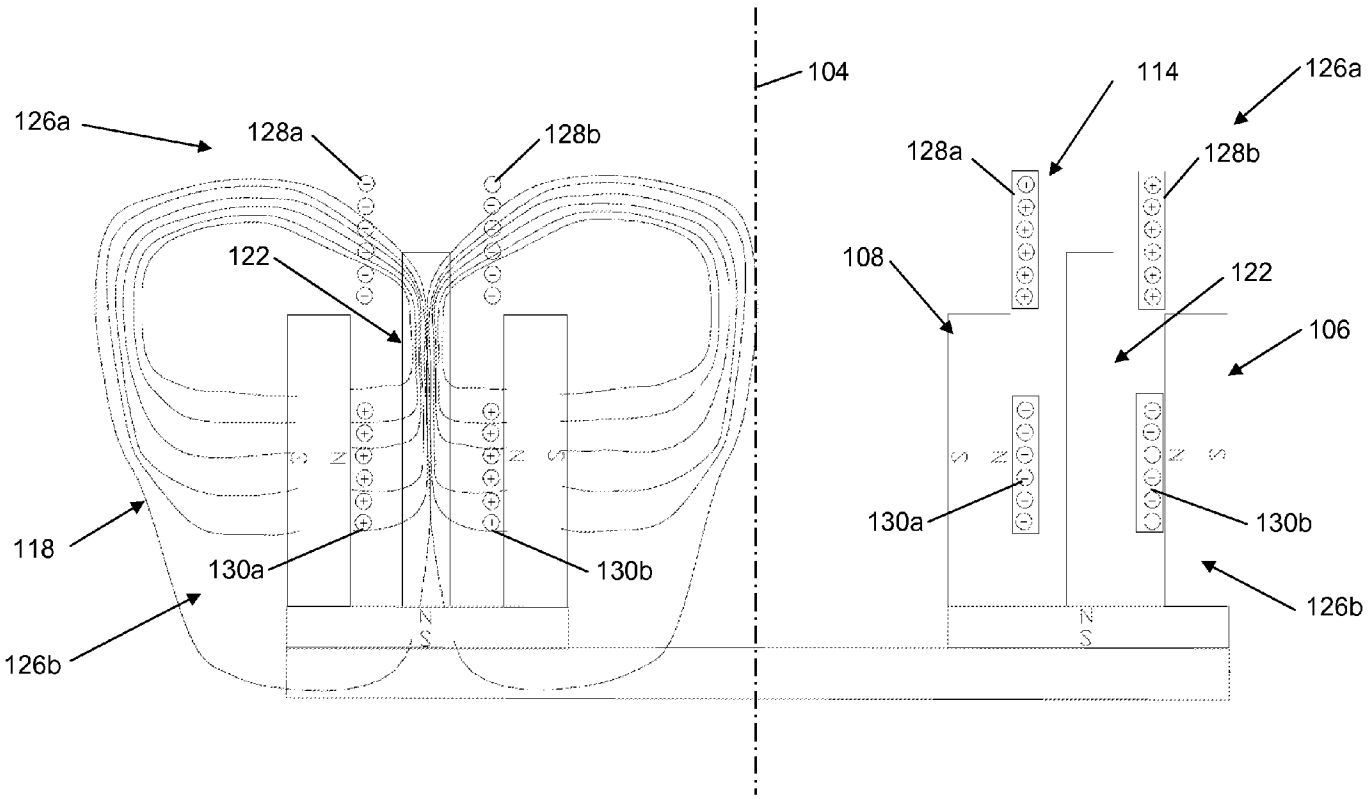
FIG. 7 is a section view of the embodiment illustrated in FIG. 6 with the addition of a means for flux concentrator an alternative coil assembly.

In certain embodiments, as illustrated in FIG. 7, a cylindrical conductive core 122 may be added to the interior 116 of the circular magnetic channel 102 to direct and confine the flux forces 118 within the channel to a particular path and concentration as illustrated in FIG. 7 (again, the flux lines are only shown on the left portion of FIG. 7 for reasons of clarity). In certain embodiments, the cylindrical conductive core 122 may be may be made from iron or a ferrite compound or powder with similar magnetic properties. In some embodiments, the ferrite compound or powder may be suspended in a viscous material, such as an insulating liquid, a lubricant, motor oil, gel, or mineral oil to reduce or eliminate eddy currents and magnetic hysteresis. In certain situations, however, such as illustrated by FIGS. 5 and 6, it may be desirable to eliminate the cylindrical conductive core 122 which its attendant small loss in efficiency.

The moveable coil assembly 114 may contain any number of groups of coil conductors depending on the particular application. In FIGS. 5 and 6, two coil conductors 124*a* and 124*b* are illustrated in a dual lateral layer configuration but any number of layers may be used. Conversely, FIG. 7 illustrates an embodiment of the moveable coil assembly 114 comprising two groups 126*a* and 126*b* of coils, where each group 126*a* and 126*b* comprise two coils 128*a*-128*b* and 130*a*-130*b*, respectively. As illustrated, the two groups of coils may be positioned longitudinally with respect to each other.

Each individual coil conductor (e.g. 124*a* or 124*b*) in the moveable coil assembly 114 may be made from a conductive material, such as copper (or a similar alloy) wire and may be constructed using conventional winding techniques known in the art. In certain embodiments, the individual coil conductors are essentially cylindrical in shape being wound around a coil core (not shown) having a center opening sized to allow the individual coil to achieve the desired diameter. In certain embodiments, the coil assemblies 114 may be constructed such that they extend beyond the channel open end as illustrated in FIG. 7.

In certain embodiments, the coil group 126*a* may be wound opposite to the coil group 126*b*. In yet other embodiments, the coil group 126*a* may be supplied with a current that has an opposite polarity than the coil group 126*b*. The coil assemblies 114 may be supported by traditional structural means known to those skilled in the art.

When a current of a particular polarity is supplied by impressing a voltage on the coil conductor assembly 114, a Lorentz force is generated within the coils moving the coil assembly perpendicular to the representative flux lines 118. In certain embodiments, the force of movement is proportional to the current supplied. Supplying an oppositely polarized current to the coil conductors will result in movement in the opposite direction.

Moving the coil assembly 114 (or the coil groups) in either direction will result in a generator effect producing a sinusoidal output in the form of an induced voltage. In certain embodiments this configuration may be useful as a means of supplying efficiently generated power outputs.

In the embodiments presented are noted several improvements to existing technology, in that stroke length can essentially be any length without increasing power or losses to move across this length. Tight clearances are not required as the magnetic flux must cross necessarily cross the air gaps and provides no significant advantage. $I^2R$ losses can be easily controlled by utilizing larger conductor size within these larger air gaps.

Thus, the disclosed embodiments eliminate or reduce the problem of prior art systems, because:

(1) Aspects of the invention may create a large flux density that remains constant through the stroke length.

(2) Stroke length is a function of desired design, rather than inhibited by conventional technology. Thus, any stroke length can be designed without an increase in power expended.

(3) Tight clearances during manufacturing and operation may not be required which allows additional flexibility in choosing conductor size and length with very little loss in flux density acting upon the coil conductors.

(4) $I^2R$ losses may be more controllable which allows the use of larger conductors with better heat transfer geometries with less limits on power transfer.

(5) Certain aspects may create counter-emf forces, but their effects are minimized.

(6) Inherent in this design is that less heat will be generated and thus less to be removed, in most cases the mass alone can easily remove generated heat.

(7) The consequence of removing these losses means less power consumed than conventional technology.

The foregoing description of the embodiments of the invention has been presented for the purposes of illustration and description. It is not intended to be exhaustive or to limit the invention to the precise form disclosed. Many combinations, modifications and variations are possible in light of the above teaching. For instance, in certain embodiments, each of the above described components and features may be individually or sequentially combined with other components or features and still be within the scope of the present invention. Undescribed embodiments which have interchanged components are still within the scope of the present invention. It is intended that the scope of the invention be limited not by this detailed description, but rather by claims based on this disclosure.

For instance, in some embodiments, there may be a transducer, comprising: a circular magnetic channel having a longitudinal axis, including: an exterior magneticcylinder positioned concentrically to the longitudinal axis and having a first plurality of magnetic poles at an interior face which are generally transverse to and pointing at the longitudinal axis; an interior magnetic cylinder positioned concentrically to the longitudinal axis and having a second plurality of magnetic poles at an exterior face which are generally transverse to and pointing away from the longitudinal axis; a base magnetic ring positioned at one longitudinal end of the exterior and interior magnetic cylinders to form the circular magnetic channel and having a third polarity of magnetic poles at an inward facing face which are generally parallel to the longitudinal axis, wherein the first plurality, second plurality, and third plurality of magnetic poles are the same polarity, a moveable coil assembly at least partially positionable within the circular magnetic channel wherein the coil assembly may move in a direction generally parallel to the longitudinal axis when current is applied to the moveable coil assembly.

The transducer of any of the above embodiments, further characterized by: the exterior magnetic cylinder having a first plurality of magnetic flux forces such that each magnetic flux force travels between a first pole on an inward face of the exterior magnetic cylinder, around an open end of the magnetic cylinder, and back to a second pole of an exterior face of the exterior magnet cylinder; the interior magnetic cylinder having a second plurality of magnetic flux forces such that each magnetic flux force travels between a first pole on an exterior face of the interior magnetic cylinder, around an open end of the interior magnetic cylinder, and back to a second pole of an inward face of the interior magnet cylinder; and the base magnetic ring having a third plurality of magnetic flux forces such that each magnetic flux force travels between a first magnetic pole of an inward face, around the open end of the circular magnetic channel, and back to a second pole of an exterior face of the base magnetic ring.

The transducer of any of the above embodiments, further characterized by a concentric conductive core channel positioned at least partially within the channel for concentrating magnetic flux forces within the channel.

The transducer of any of the above embodiments, wherein the direction is dependent on the polarity of the applied current.

The transducer of any of the above embodiments, further characterized by a conductive back plate positioned adjacent to the base magnetic ring.

The transducer of any of the above embodiments, where the coil assembly is further characterized by at least a first coil and a second coil such that the first coil is in proximity with the interior face of the exterior magnetic cylinder and the second coil is in proximity with the exterior face of the interior magnetic cylinder.

The transducer of any of the above embodiments, where the coil assembly is further characterized by: a first coil subassembly including: a first coil positioned in proximity with the interior channel face of the exterior magnetic cylinder, and a second coil positioned in proximity with the interior channel face of the interior magnetic cylinder; a second coil subassembly including: a third coil positioned longitudinally apart from the first coil, and a fourth coil positioned longitudinally apart from the second coil.

The transducer of any of the above embodiments, wherein the polarity of the current of the first coil subassembly is different than the polarity of the current of the second coil subassembly.

The transducer of any of the above embodiments, wherein the first coil subassembly is wound in an opposite direction than the second coil subassembly.

The transducer of any of the above embodiments, wherein the transducer is a voice coil.

The transducer of any of the above embodiments, wherein the voice coil is part of a speaker.

A method of moving a transducer, the method comprising: forming a first plurality of magnetic poles having a first plurality of magnetic flux lines at an interior face of an exterior magnetic cylinder positioned concentrically about a longitudinal axis such that the magnetic poles at the interior face are generally transverse to and pointing at the longitudinal axis; forming a second plurality of magnetic poles having a second plurality of magnetic flux lines at an exterior face of an interior magnetic cylinder positioned concentrically about the longitudinal axis such that the second plurality of magnetic poles at the exterior face are generally transverse to and face away from the longitudinal axis; forming a third plurality of magnetic poles having a third plurality of magnetic flux lines at an inward channel face of a base magnetic ring positioned at one longitudinal end of the exterior and interior magnetic cylinders to form a circular magnetic channel wherein the third plurality of magnetic poles are generally parallel to the longitudinal axis at the inward channel face, wherein the first plurality, second plurality, and third plurality of magnetic poles are the same polarity, applying a current to a moveable coil assembly at least partially position within the circular magnetic channel, moving the coil assembly in a desired direction in response to the applied current and polarity.

The method of any of the above embodiments, further characterized by: forming a first plurality of magnetic flux forces such that each magnetic flux force travels between a first pole on an inward face of the exterior magnetic cylinder, around an open end of the magnetic cylinder, and back to a second pole of an outward face of the exterior magnet cylinder; forming a second plurality of magnetic flux forces such that each magnetic flux force travels between a first pole on an exterior face of the interior magnetic cylinder, around an open end of the interior magnetic cylinder, and back to a second pole of an interior face of the interior magnet cylinder; forming a third plurality of magnetic flux forces such that each magnetic flux force travels between a first magnetic pole on a first face of the base magnetic ring, around the open end of the circular magnetic channel and back to a second pole of an exterior face of the base magnetic ring.

The method of any of the above embodiments, wherein the desired direction is dependent on the polarity of the applied current.

The method of any of the above embodiments, further characterized by concentrating magnetic flux within the circular magnetic channel by partially positioning a conductive core cylinder within the circular magnetic channel.

The method of any of the above embodiments, wherein the applying current to a moveable coil assembly is further characterized by: applying current to a first coil that is in proximity with the interior face of the exterior magnetic cylinder and, applying current to a second coil that is in proximity with the exterior face of the interior magnetic cylinder.

The method of any of the above embodiments, wherein the applying current to a moveable coil assembly is further characterized by: applying current to a first coil subassembly including: applying current to a first coil positioned in proximity with the channel face of the exterior magnetic cylinder, and applying current to a second coil such that the second coil is in proximity with the channel face of the interior magnetic cylinder; applying current to a second coil subassembly including: applying current to a third coil positioned in proximity with the channel face of the exterior magnetic cylinder, and applying current to a fourth coil positioned in proximity with the channel face of the interior magnetic cylinder; wherein the first coil assembly is positioned longitudinally with respect to the second coil assembly.

The method of any of the above embodiments, wherein the polarity of the current of the first coil subassembly is different than the polarity of the current of the second coil subassembly.

The method of any of the above embodiments, further characterized by coupling a speaker cone to the coil assembly such that when the coil assembly moves, the speaker cone moves to generate an air waive.

The method of any of the above embodiments, further characterized by controlling $I^2R$ losses by utilizing large conductor sizes.

The method of any of the above embodiments, further characterized by dissipating heat with large air gaps between the coil assembly and the face of the respective magnetic cylinders.

The invention claimed is:

1. A transducer component comprising:

a circular ring defining a circular channel positioned around an axial axis, the circular channel having a cross-section defined by:

a magnetic exterior wall having a first surface and first magnetic pole facing radially towards the axial axis;

a magnetic interior wall having a second surface and second magnetic pole facing radially away from the axial axis;

a magnetic base wall spanning in a radial direction and adjoining the magnetic exterior wall and the second magnetic exterior wall, the base magnetic wall having a third surface and third magnetic pole facing into the circular channel and substantially parallel to the axial axis;

wherein the first magnetic pole, the second magnetic pole, and the third magnetic pole are of the same magnetic polarity;

a ring of core material positioned concentrically within the circular channel;

a first moveable ring coil assembly positioned concentrically and partially within the circular channel between the ring of core material and the first surface, wherein the first moveable ring coil assembly is moveable in a direction that is generally parallel to the axial axis; and a second moveable ring coil assembly positioned concentrically and partially within the circular channel between the ring of core material and the second surface wherein the second moveable ring coil is moveable in a direction that is generally parallel to the axial axis.

2. The transducer component of claim 1, further comprising a conductive back plate positioned adjacent to the base magnetic wall.

3. The transducer component of claim 1, wherein the direction of movement of the first and second moveable ring coil assemblies is dependent on the polarity of current applied to the first and second coil assemblies.

4. The transducer component of claim 3, wherein the polarity of the current of the first moveable ring coil assembly is different than the polarity of the current in the second moveable ring coil assembly.

5. The transducer component of claim 1, wherein the first moveable ring coil assembly is wound in an opposite direction to that of the second moveable ring coil assembly.

6. The transducer component of claim 1, wherein the core ring material is selected from a group consisting of iron, a ferrite compound, or a ferrite powder suspended in a viscous material.

7. The transducer component of claim 1, wherein a portion of the material forming the first moveable ring coil assembly or the second moveable ring coil assembly is formed from copper wire.

8. The transducer component of claim 1, wherein a portion of the first or second moveable ring coil assembly extends axially beyond the circular channel.

9. The transducer component of claim 1, wherein the first moveable ring coil assembly further comprises: a first coil positioned in proximity with an interior channel face of the circular channel, and a second coil positioned axially from the first coil.

10. The transducer component of claim 1, wherein the second moveable ring coil assembly further comprises: a third coil positioned in proximity with an opposing interior channel face of the circular channel, and a fourth coil positioned axially from the first coil.

11. A speaker component comprising:

a circular ring defining a circular channel positioned around an axial axis, the circular channel having a cross-section defined by:

a magnetic exterior wall having a first surface and first magnetic pole facing radially towards the axial axis;

a magnetic interior wall having a second surface and second magnetic pole facing radially away from the axial axis;

a base magnetic wall spanning in a radial direction and adjoining the magnetic exterior wall and the second magnetic exterior wall, the base magnetic wall having a third surface and third magnetic pole facing into the circular channel and substantially parallel to the axial axis;

wherein the first magnetic pole, the second magnetic pole, and the third magnetic pole are of the same magnetic polarity;

a first moveable ring coil assembly positioned concentrically and adjacent to the first surface, wherein the first moveable ring coil assembly is moveable in a direction that is generally parallel to the axial axis; and a second moveable ring coil assembly positioned concentrically and adjacent to the second surface wherein the second moveable ring coil is moveable in a direction that is generally parallel to the axial axis.

12. The speaker component of claim 11, further comprising a ring of core material positioned concentrically within the circular channel between the first moveable ring coil assembly and the second moveable ring coil assembly.

13. The speaker component of claim 12, further comprising a conductive back plate positioned adjacent to the base magnetic wall.

14. The speaker component of claim 11, wherein the direction of movement of the first and second moveable ring coil assemblies is dependent on the polarity of current applied to the first and second coil assemblies.

15. The speaker component of claim 11, wherein the polarity of the current of the first moveable ring coil assembly is different than the polarity of the current in the second moveable ring coil assembly.

16. The speaker component of claim 11, wherein the first moveable ring coil assembly is wound in an opposite direction to that of the second moveable ring coil assembly.

17. The speaker component of claim 12, wherein the material forming the core is selected from a group consisting of iron, a ferrite compound, or a ferrite powder suspended in a viscous material.

18. The speaker component of claim 11, wherein a portion of the first or second moveable ring coil assembly extends axially beyond the circular channel.

19. The speaker component of claim 11, wherein the first moveable ring coil assembly further comprises: a first coil positioned in proximity with an interior channel face of the circular channel, and a second coil positioned axially from the first coil.

20. The speaker component of claim 11, wherein the second moveable ring coil assembly further comprises: a third coil positioned in proximity with an opposing interior channel face of the circular channel, and a fourth coil positioned axially from the first coil.

* * * * *